United States Patent [19]

Hofstad

[11] Patent Number: 4,902,204

[45] Date of Patent: Feb. 20, 1990

[54] VERTICAL SUBMERSIBLE PUMP ASSEMBLY

[75] Inventor: Åge Hofstad, Tranby, Norway

[73] Assignee: Kvaerner-Eureka A/S, Tranby, Norway

[21] Appl. No.: 258,665

[22] Filed: Oct. 17, 1988

[30] Foreign Application Priority Data

Oct. 26, 1987 [NO] Norway ..... 874456

[51] Int. Cl.[4] ..... F04B 35/00

[52] U.S. Cl. ..... 417/360; 417/405; 417/423.15

[58] Field of Search ..... 417/360, 405, 406, 407, 417/423.3, 423.15, 361, 363; 285/370, 415

[56] References Cited

U.S. PATENT DOCUMENTS

| | | | |
|---|---|---|---|
| 1,942,570 | 1/1934 | Reed | 417/406 |
| 4,661,047 | 4/1987 | Weis | 417/360 |
| 4,756,671 | 7/1988 | Grimes et al. | 417/53 |

FOREIGN PATENT DOCUMENTS 2706110 8/1978 Fed. Rep. of Germany .

*Primary Examiner*—John J. Vrablik
*Assistant Examiner*—Robert N. Blackmon
*Attorney, Agent, or Firm*—Young & Thompson

[57] ABSTRACT

The invention relates to a vertical submersible pump assembly, comprising a pump assembly casing which contains a hydraulic drive motor with a drive shaft. On the pump assembly casing a pump house is secured, and a pump rotor which is connected with the pump shaft and provided in the pump house, a transport conduit from the pump house, which transport conduit extends above the pump medium, and two drive medium conduits from the above said pump medium and down to the pump assembly casing. The vertical submersible pump assembly is characterized by the fact that the pump house is divided radially outside the pump rotor, the external ring shaped pump house portion being connected with the transport conduit. Each drive medium conduit comprises a releasable conduit means which when removed permits a unit compressing pump assembly casing with the drive motor, the pump rotor and the inner pump house portion to be pulled up.

3 Claims, 3 Drawing Sheets

VERTICAL SUBMERSIBLE PUMP ASSEMBLY

The invention relates to a vertical submersible pump assembly as stated in the preamble of claim 1.

For maintenance and overhaul the entire pump assembly is pulled up through a hatch in the ship's deck unless it is decided to carry out necessary operations down in the emptied tank. Prevailing conditions in an empty tank would often prevent such operations. The bottom of the tank would be slippery and it would, thus, be necessary to clean the inside of the tank and the outside of the pump assembly before it is possible to get at the interior of the latter. There is also an obvious hazard due to the gaseous atmosphere that would be present in the tank.

In moderns ships cargo tanks are deep, and the vertical submersible pump assemblies have, thus, a corresponding length.

The invention provides a possibility of fetching up the portion of interest of the pump assembly as a unit in connection with maintenance and overhaul. The unit in question would comprise the driving motor, its driving shaft, and the pump driven by said driving motor. Transport conduits, and conduits for driving medium may, thus, remain in the tank. Release of the unit only requires one man's effort to carry out the desired release tasks, with such a person being dressed in possibly necessary safety equipment.

According to the invention this is achieved by the fact that a pump assembly as mentioned above is designed as stated in the characterizing part of claim 1.

Further features of the invention are stated in the dependent claims.

The advantages of the invention will be disclosed in more detail in conenction with the following description of a preferred embodiment of the invention.

Figure 1:
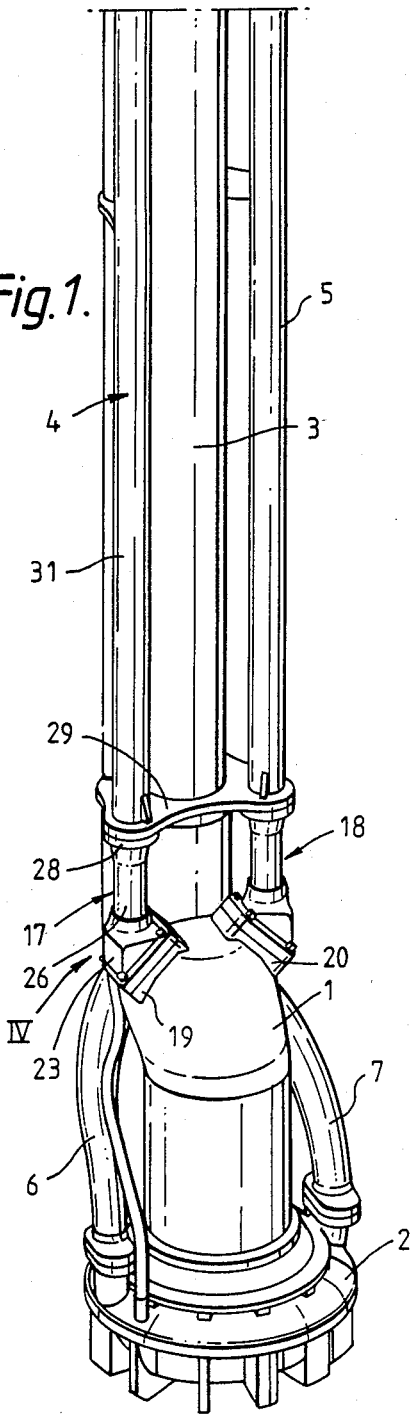
Figure 2:
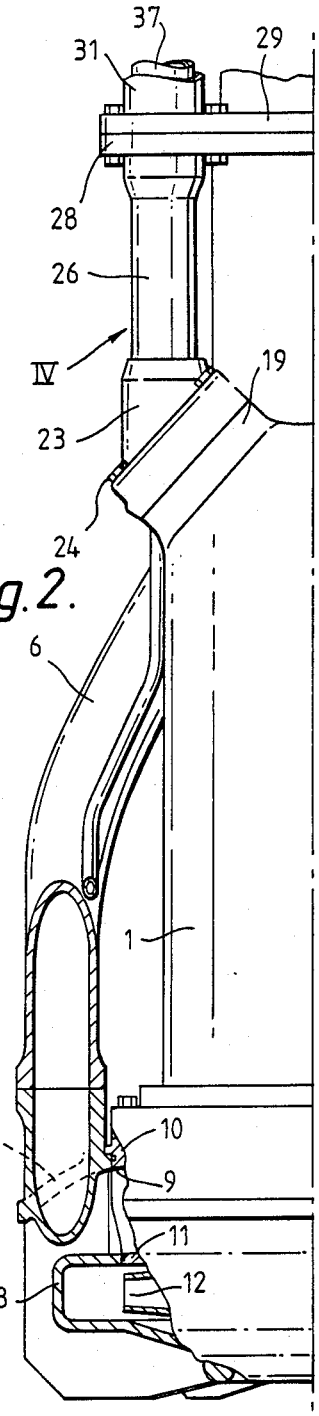
Figure 3:
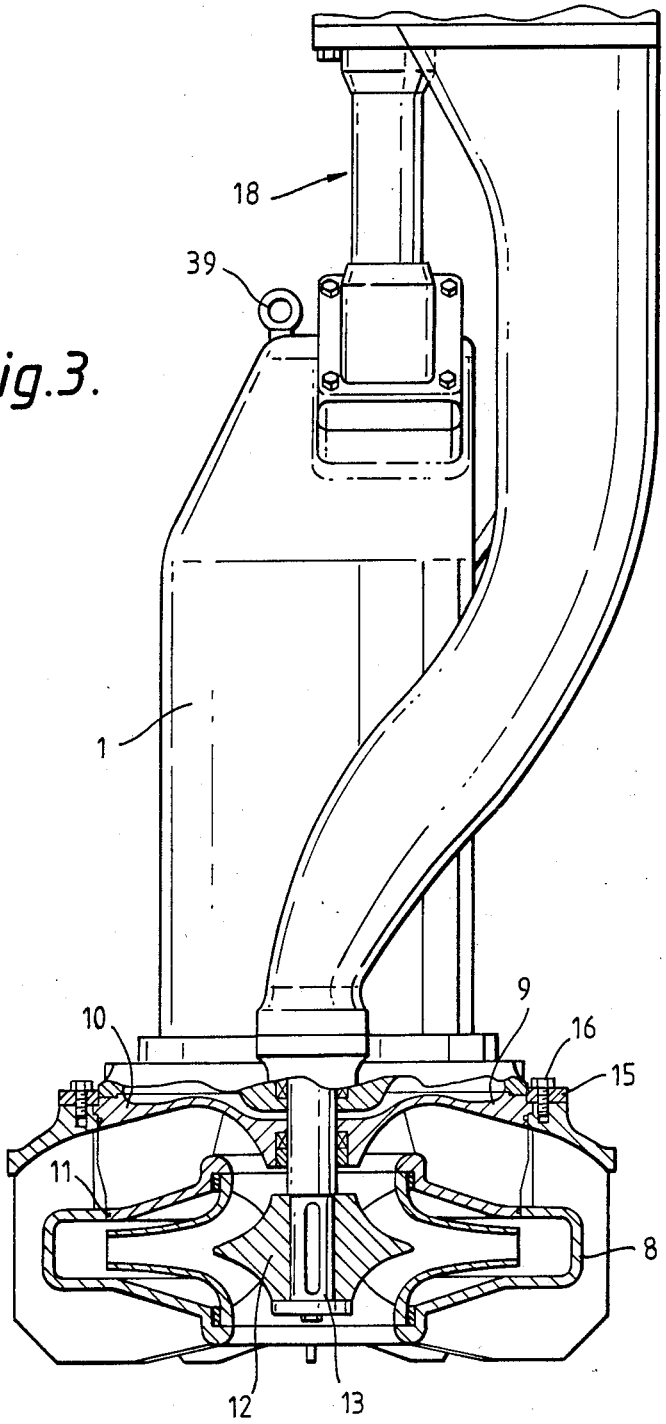
Figure 4:
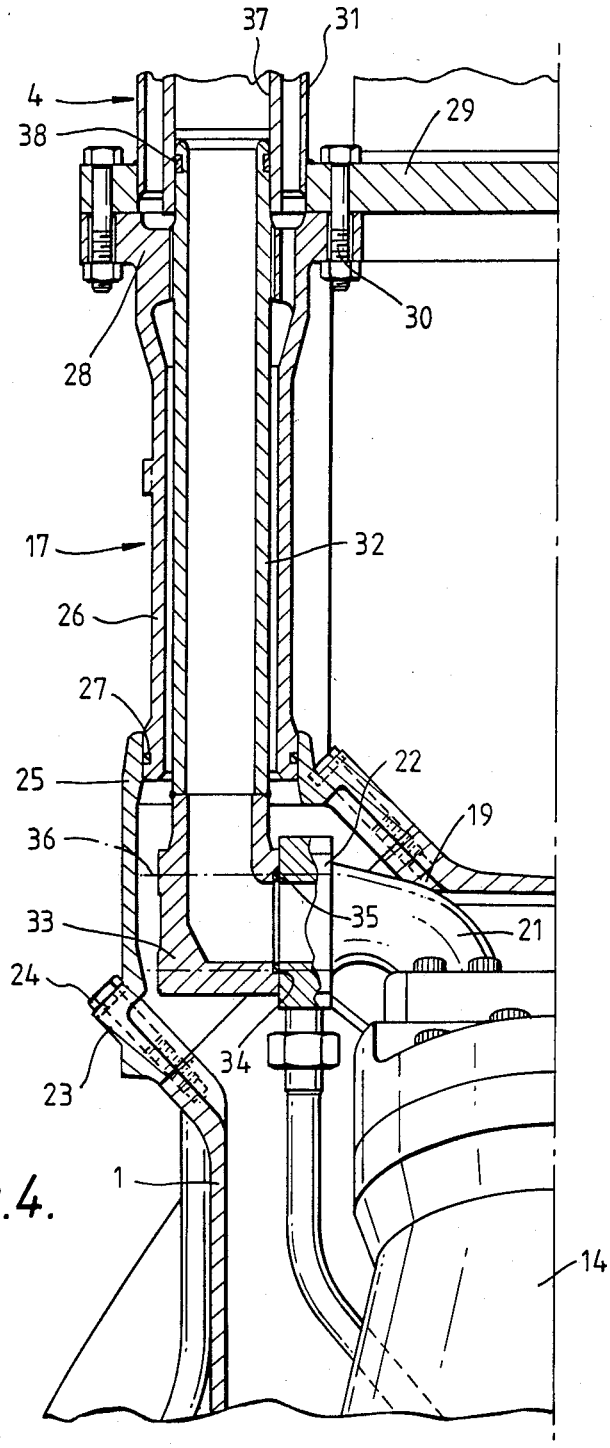

FIG. 1 is an elevation in perspective of the lower portion of a vertical submersible pump assembly, FIG. 2 shows the pump assembly casing, partly in elevation, and partly in section, FIG. 3 is an elevational view of the pump assembly casing, turned 90° in relation to FIG. 2, and with a sectional view of the pump house, and FIG. 4 is a partial sectional view at a larger scale of the area IV—IV in FIGS. 1 and 2.

The submersible pump assembly shown in FIG. 1 comprises mainly a pump assembly casing 1, a pump house 2, a transport conduit 3, and two driving medium conduits 4,5. Pump house 2 is connected with transport conduit 3 by the aid of two Y-pipe passages 6,7.

As shown in FIGS. 2 and 3, pump house 2 is built with a radial joint and, thus, consists of a lower outside pump house portion 8, and an upper inner pump house portion 9. The lower, outer pump house portion 8 encloses upper inner pump house portion 9. Suitable gaskets 10,11 are provided between them.

In the pump house a double sided pump rotor 12 is provided. The pump rotor sits on a driving shaft 13 extending from a hydraulic driving motor 14 (FIG. 4) in pump assembly casing 1.

Pump house portions 8 and 9 are joined by the aid of a holder ring means 15 which is in contact with inner upper pump house portion 9, and is attached to lower outer pump house portion 8 by the aid of screws 16. Pump house 2 is provided with an upper and a lower inlet for the double sided pump rotor 12, as shown.

Releasable conduit means 17, and 18, respectively, are provided in both driving medium conduits 4,5. Each of them is built as shown in more detail in the sectional view of FIG. 4.

As shown in FIG. 1, pump assembly casing 1 has two socket openings 19,20. The socket openings and associated releasable pipe means are identical and, thus, only one of the connecting means will be disclosed in detail below.

As shown in FIG. 4 drive motor 14 has a connecting socket 21 with a coupling flange 22. Coupling flange 22, as shown, is accessible in opening 19 of the pump assembly casing. A flange coupling casing 23 is screwed tightly on opening 19 by screws 24, with a gasket inserted between members. Flange coupling casing 23 is provided with a socket member 25 extending vertically upwards. An external protecting pipe member 26 is slidably tightened 27 in socket 25, extends upwards for a distance, and is completed by a flange 28. Said flange 28 is in contact with a flange plate 29 with an inserted gasket (also see FIG. 1), and is connected with plate 29 by screws 30. An external protective pipe 31 is secured to flange plate 20 and extends upwards to form an external member in driving medium conduit 4.

A driving medium pipe member 32 is provided inside said external protective pipe member 26 and is at its lower end firmly connected with an elbow 33 which is provided with a laterally facing end face 34 in contact with flange 22 with gasket 35 inserted between said members. End face 34 is kept in a tightening contact with flange 22 by the aid of screws 36 which are indicated by dashed lines. On top, internal driving medium pipe 32 is introduced into an inner driving medium bearing pipe 37 extending upwards in the protecting pipe 31. By the aid of suitable gaskets 38 inner pipe member 32 is slidingly tightened in the inner driving medium bearing pipe 37.

When it is desired to remove the drive motor and the pump proper for maintenance or overhaul, operations are as follows: The driving medium pipes are closed and drained in a manner known per se (not shown). Screws 24 are loosened and flange coupling casing 23 may now be slidably moved up along external pipe member 26 to make screws 36 accessable. Said screws are loosened to make knee 33 and the associated inner pipe member 32 releasable from the connection with flange 22. Screws 36 are loosened and the entire releasable conduit member 17 may now be pulled down and out, inner pipe member 32 sliding out of inner driving medium bearing pipe 37. Screws 16, which hold holder ring 15, are loosened. A unit comprising pump assembly casing 1 with internal members, and inner upper pump house 9, which is connected with pump assembly casing 1 in a manner not shown in detail, as well as pump rotor 12 sitting on drive shaft 13 may now be pulled up, e.g. by the aid of a rope which is fastened to lifting ear 39 (FIG. 3).

For mounting operations are reversed. Assembly 1 with the connected inner upper pump house portion 9, and pump rotor 12 are lowered, and pump house portions 9 and 8 are connected by holder ring 15. The releasable conduit members 17, 18 are set in place, operations being reversed in relation to the above mentioned as regards dismantling conduit member 17. Driving medium vearing conduits 4,5 are then filled up with driving medium, and the pump assembly is ready for use.

Having described my invention, I claim:

1. A vertical submersible pump assembly, comprising a pump assembly casing which contains a hydraulic drive motor with a drive shaft, a pump housing which is secured on said pump assembly casing, a pump rotor positioned within the pump housing and connected with the drive shaft, a transport conduit extending upwardly from the pump housing, and two driving medium conduits which extend upwardly from the pump assembly casing, wherein the pump housing is radially divided along a first circumference outside the pump rotor into inner and outer pump housing portions, said pump housing including an external ring-shaped portion connected to the transport conduit, and each drive medium conduit, comprising a releasable conduit means, said releasable conduit means when removed permitting a unit comprising said pump assembly casing to be displaced upwardly together with the drive motor, the pump rotor and the inner pump housing portion.

2. A vertical submersible pump assembly as defined in claim 1, wherein each releasable conduit means is comprised of multiple members capable of coaxial movement.

3. A vertical submersible pump assembly as defined in claim 2, wherein the releasable conduit means comprises an external flange coupling casing with a vertically oriented pipe socket, which casing is coupled with the pump assembly casing by means of a flange coupling, and an external protective pipe member one end of which is slidingly received in pipe socket and an opposing end of which is coupled by means of a flange with an associated external protective pipe in the associated drive medium conduit, a drive medium pipe member having an upper and which is slidingly received in an associated inner drive medium bearing pipe in the associated drive medium conduit, and a lower end of which extends into the flange coupling casing through said external protective pipe member and at its lower end is provided with an inner flange coupling casing for the flange coupling with a drive medium socket on the drive motor, said inner and external flange coupling casings being mutually dimensioned to permit the external flange coupling casing to slide upwardly along the external protective pipe member to expose the inner flange coupling casing.

* * * * *